United States Patent [19]

Frey

[11] 4,033,560

[45] July 5, 1977

[54] PAPER ADVANCING MECHANISM

[75] Inventor: Frederick E. Frey, Irvine, Calif.

[73] Assignee: Rockwell International Corporation, El Segundo, Calif.

[22] Filed: Aug. 6, 1975

[21] Appl. No.: 602,360

[52] U.S. Cl. ..... 226/157; 226/114

[51] Int. Cl.[2] ..... B65H 17/22

[58] Field of Search ..... 226/114, 157, 195

[56] References Cited

UNITED STATES PATENTS

| | | | |
|---|---|---|---|
| 489,787 | 1/1893 | Bowen | 226/157 |
| 893,493 | 7/1908 | Harris et al. | 226/157 |
| 2,311,966 | 2/1943 | Rinehart et al. | 226/157 |
| 3,677,452 | 7/1972 | Wallace | 226/157 |

*Primary Examiner*—Robert W. Saifer

*Attorney, Agent, or Firm*—H. Fredrick Hamann; G. Donald Weber, Jr.; Roland G. Rubalcava

[57] ABSTRACT

A mechanism for advancing paper from a supply in incremental steps. The paper is initially fed into a loading slot formed by a paper guide and a rotating roller. The roller advances the paper through a paper stripper to a printing station.

The rotation of the roller is accomplished by a ratchet mechanism which is activated by a double acting driver which in turn is driven by a solenoid assembly. The ratchet mechanism and driver also activate a retracting pressure bar which insures intimate contact between the paper and the printing station. The pressure bar pulls a paper stripper which positively strips the paper from the print station in preparation for paper advancement.

16 Claims, 9 Drawing Figures

PAPER ADVANCING MECHANISM

BACKGROUND OF THE INVENTION

1. Field of the Invention

This invention relates to a low cost paper moving mechanism for use with printing devices such as calculators, typewriters, line printers, and the like operating under electronic control.

2. Description of the Prior Art

Many low cost printers using paper advancing mechanisms are known in the art. However, the known prior art mechanisms are generally quite complex and have many parts. With increased complexity, there arises the attendant increases in cost of fabrication and maintenance. Also, down time is generally increased as a function of complexity and increased number of parts.

SUMMARY OF THE INVENTION

This invention relates to an improved, low cost paper advancing mechanism for selectively moving paper relative to a printing station. The mechanism includes a support structure for housing the various components by which paper or other suitable medium is advanced with controlled pressure and self alignment in incremental steps. The incremental rotation of the roller is accomplished by a toothed ratchet attached to a roller shaft. The ratchet is driven by a double acting driver which engages surfaces of the ratchet. The driver is driven by a solenoid assembly. To assure that the paper is separated from the print station before being advanced, a paper stripper, attached to a spring-loaded pressure bar, is activated by the driver. The paper stripper retracts and pulls the paper from the print station, thus permitting the paper to advance.

DESCRIPTION OF A PREFERRED EMBODIMENT

Figure 1:
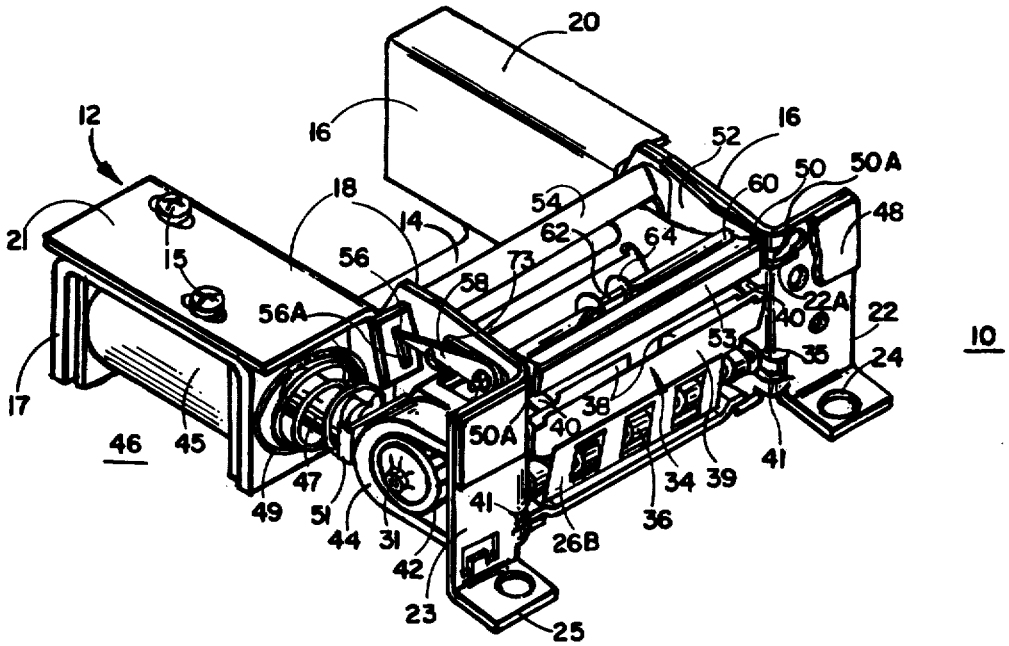
FIG. 1 is a perspective view of one embodiment of the apparatus of the present invention.

Referring to FIG. 1, there is shown a perspective view of paper advancing mechanism 10. This perspective view provides a general overall view of the mechanism. Details of the mechanism are shown in other figures. Paper advancing mechanism 10 includes support structure 12 preferably (but not limitatively) fabricated of metal, plastic or the like. Support structure 12 includes base member 14 as well as sides 16 and 18 which extend generally upwardly from and beyond base member 14. The rear top section of side 16 has a flange 20 extending outwardly from structure 12 for structural strength, mounting or the like. The front section of side 16 also has a flange 22 which extends outwardly from structure 12 and a smaller flange 24 extending outwardly from the lower front section of flange 22. Side 18 includes a large rear-top flange 21, front flange 23 and smaller front flange 25. Flanges 22 and 23 are useful for mounting elements onto the mechanism. Flanges 24 and 25 are useful for mounting the mechanism onto a utility device. Flanges 24 and 25 may be omitted and the function thereof performed by other elements if desired. The print station, for example a thermal printhead, is mounted on flanges 22 and 23. In this figure, printer element 48 is shown partially broken away for convenience.

Solenoid assembly 46 includes mounting bracket 17, solenoid coil 45, plunger 47, return spring 49 and clip 51. Solenoid assembly 46 is attached to flange 21 by any suitable mounting means, for example screws or bolts 15. This is, screws 15 connect U-shaped bracket 17 to flange 21. Solenoid coil 45 is mounted in bracket 17 in any suitable manner. Plunger 47, which moves in the typical manner in response to activation of coil 45, is connected to Y-head driver 44 by clip 51 or any other suitable means. Return spring 49 is mounted between bracket 17 and clip 51 for returning drive head 44 to a rest position. Return spring 49 may preferably be a cone-spring which has a non-linear spring constant to approximate the non-linear force-displacement characteristic of solenoid 45.

Disposed inside Y-head driver 44 is ratchet wheel 42. Ratchet wheel 42 has a plurality of "teeth" around the periphery thereof. These teeth are selectively engaged by driver 44. Ratchet wheel 42 is mounted on shaft 31 which supports drive roller 32 (see FIG. 2).

Figure 7:
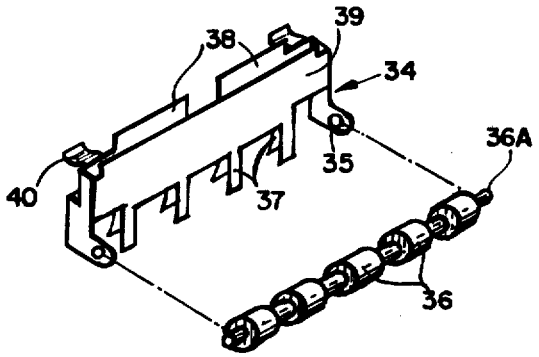
FIG. 7 is a perspective view illustrating details of the paper stripper and drive idler.

Also mounted to structure 12 is paper stripper assembly 34 and paper drive idler 36 (seen best in FIG. 7). The shaft of drive idler 36 is mounted in slots 41 in flanges 22 and 23 of frame 12 and serves to mount stripper assembly 34 as well. That is, shaft 36A of drive idler passes through holes in tabs 35 and into slots 41 for mounting purposes. The configuration of paper stripper 34 is such that it forms a paper guide for preventing the paper from following drive roller 32 (see FIG. 2). Two large tabs 38 and cutter edge 39 form an upper guide portion of paper stripper 34 (seen best in FIG. 7). Drive idler 36 includes a plurality of collars (for example, five) on a single shaft. The collars protrude through the apertures of idler spring portion 26B. The collars of drive idler 36 are generally, elliptical (or assymetrical) in shape. The collars tend to abut drive roller 32 and to be driven thereby. As the collars rotate on the shaft, a cam-like effect occurs. This effect intermittently relieves the pressure between drive idler 36 and drive roller 32 (see FIG. 2), thereby assuring controlled pressure and allowing the paper to advance in a self-aligning manner. As the paper advances it is aligned between the sides 16 and 18 of the structure 12 which form paper edge guides. If the paper misaligns it comes into contact with either side 16 or 18, which force it back into alignment. The intermittent pressure between drive idler 36 and drive roller 32 allows the paper to "walk" under the influence of this realigning force to achieve proper alignment. The collars of drive idler 36 are preferably but not limitatively elliptical since any shape which serves to press the paper against drive roller 32 will serve to advance the paper, although the self-aligning effect may be reduced.

Pressure bar 50, which includes pressure pad 53 on the front surface thereof, assures that the paper is held in intimate contact with the printer element 48 during a printing operation. Pressure bar 50 is connected to a retracting mechanism including a pair of retractor members 52. That is, a pair of tabs 50A extend from the ends of pressure bar 50 through slots in retractor member 52. Tabs 50A extend into slots 22A (and 23A) for alignment. In addition, shaft 60 and bar 54 fits through matching slots in opposite sides of frame 12 and in each of the retractor members 52. Retracting members 52 assure that pressure bar 50 and pressure pad 53 are retracted uniformly when paper is being moved and are free to align squarely with print station 48 when in the forward printing position.

Pressure spring 62 is mounted on shaft 60 and abuts the back of pressure bar 50 to exert pressure thereon. Thus, there is provided a spring-loaded effect by pressure bar 50 to ensure intimate contact of the paper against print station 48. Typically, pressure springs 62 are leaf springs which are inserted through spring holder 64 which in turn is secured by pressing shaft 60 through apertures.

To assure that the pressure bar 50 and pressure pad 53 remain in the retracted position to allow the paper to advance they are held by latch 58, operating through lever arm 56 and pressure lever bar 54. Latch member 58 has an L-shaped configuration. The corner of latch 58 is pivotally attached to one end of shaft 60 by suitable means. One end of latch 58 has a steplike configuration and fits through slot 56A formed in lever arm 56 which extends from pressure lever bar 54. Spring 73 engages latch 58 and urges the latch upwardly to pivot around shaft 60 whereby bar 54 is selectively latched by latch member 58. The other end of latch member 58 (see FIG. 4) engages Y-head driver 44 as described hereinafter.

Figure 2:
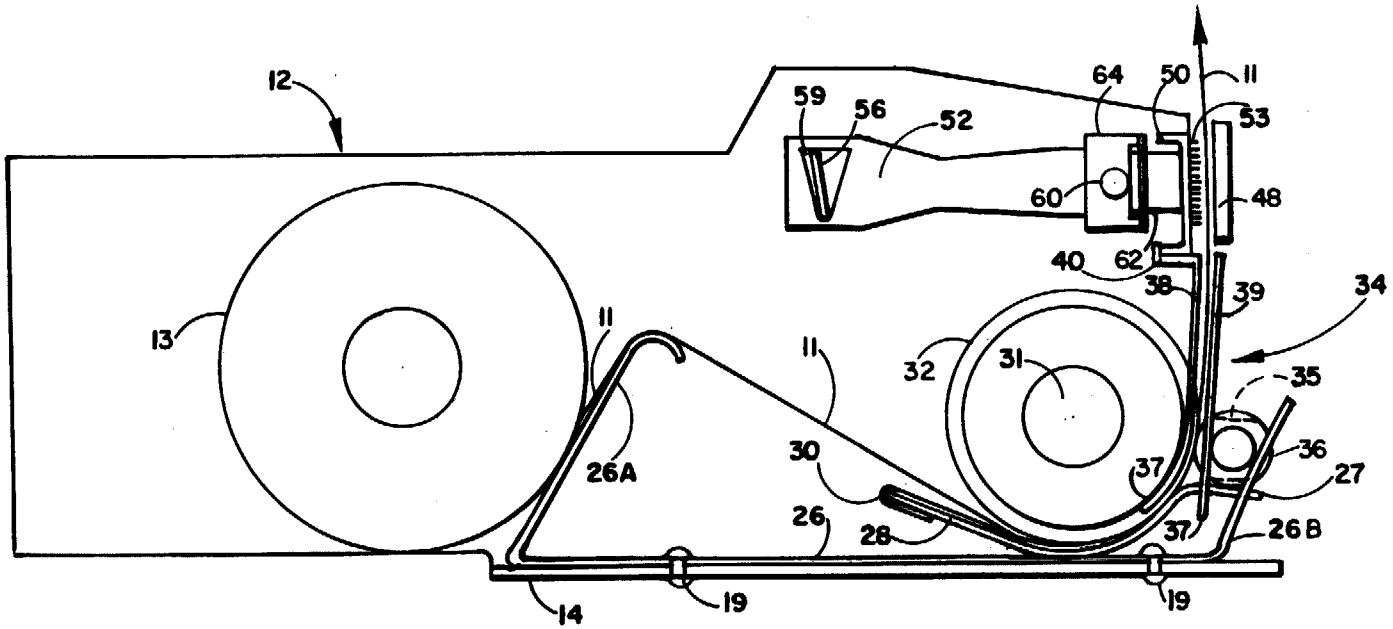
FIG. 2 is a side view of the apparatus with portions broken away to show the paper path in the apparatus shown in FIG. 1.

Referring now to FIG. 2, there is shown a schematic, cutaway side-view of the apparatus of FIG. 1. Paper 11 is provided from a suitable supply such as supply roll 13. Idler spring 26 is mounted within structure 12 on base 14 by means of rivets 19 or the like. To allow for supply roll inertia and for paper feed resistance, free-standing portion 26A of idler spring 26 is arranged to flex under pressure but to return to the generally upright position shown. Idler spring 26 includes a front vertical portion 26B having substantially rectangular apertures therein as shown in FIG. 1. The configuration shown is reprsentative of a preferred embodiment but is not intended to be limitative of the invention. For example, spring portions 26A and 26b may be separately provided.

Also mounted within structure 12 is paper guide 28 (shown in detail in FIG. 6), which overlies a portion of idler spring 26 and forms a guideway for leading paper 11 to roller 32. Paper guide 28 may be retained in structure 12 in any suitable manner. Horizontal tabs 27 extend from paper guide 28 for purposes of alignment with stripper assembly 34. A relatively thin metal leaf spring 30 may be fitted onto paper guide 28 to assure that paper 11 is directed into contact with drive roller 32.

Drive roller 32 is rotatably mounted in structure 12 on shaft 31 for selectively driving the paper from idler spring 26 and paper guide 28 to the print station 48.

Paper stripper assembly 34, comprising tabs 38 and cutter edge 39 is mounted in structure 12 by means of shaft 36A which supports collars 36. Shaft 36A passes through holes in tabs 35 for mounting purposes. The lower edges 37 of tabs 38 and cutter edge 39 may be flared to facilitate admission of paper therebetween. End tabs 40 and stripper tabs 38 engage and retain pressure bar 50. Thus, stripper assembly 34 can be moved with pressure bar 50 which is connected to retractor 52. Therefore, when pressure 50 is retracted by retractor 52, stripper assembly 34 also moves and pulls paper 11 from print station 48. This arrangement is desirable to remove paper 11 from a thermal printer element inasmuch as the paper occasionally sticks to the heated element.

Paper 11 (or suitable material) advances over leaf spring 26A into a guideway formed by paper guide 28 (and leaf spring 26A) and roller 32. Leaf spring 26A is arranged to cause paper 11 to enter the guideway in a direction assuring about 90° to 120° arc of contact between the paper and roller 32 for minimizing the friction force available to draw the paper from the supply and drive it through the print station. Roller 32 then drives paper 11 substantially vertically between tabs 37 of lower guide portion of paper stripper 34. Drive idler collars 36 act as pinch rollers and maintain paper 11 in contact with roller 32. Paper 11 advances through stripper 34 which prevents the paper from following roller 32 and through the upper guide (between tabs 38 and cutter edge 39) of stripper 34. Paper 11 exits the mechanism, as shown by the arrow, between pressure pad 53 and print station 48.

Figure 3:
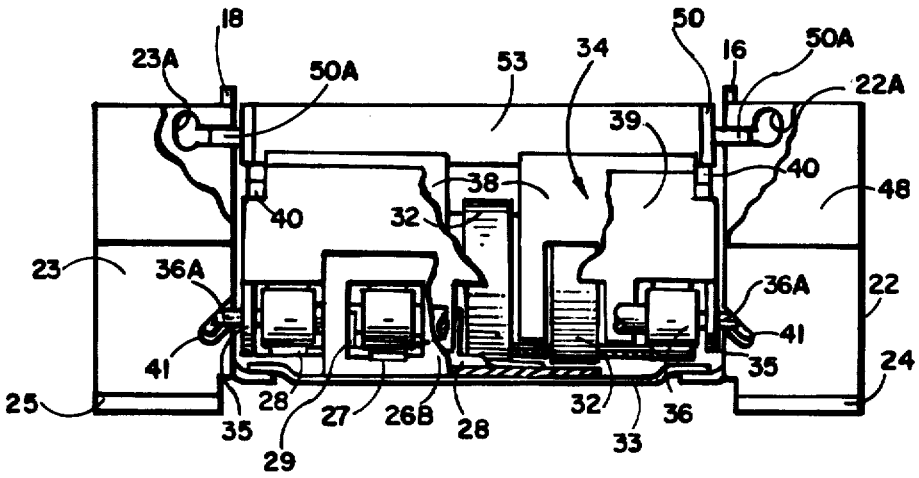
FIG. 3 is a partially broken away front view of the apparatus shown in FIG. 1.

Referring now to FIG. 3, there is shown a front view which is broken away in layers to better illustrate the inter-relation of portion 26B of idler spring 26, paper guide 28, rotating rollers 32, paper stripper 34 and drive idler 36. Horizontal tabs 27 of paper guide 28 protrudes through spring portion 26B under the drive idler 36 collars. Vertical tabs 29 (see FIG. 6) from paper guide 28 are disposed in the grooves of roller 32. Roller 32 is behind tabs 38 and cutter edge 39 of the paper stripper 34. Drive idler shaft 36A is mounted in slots 41 of frame 12. The compactness of these advance components assures controlled pressure of the paper and substantially reduces misalignment of the paper.

Pressure pad 53 is disposed on pressure bar 50 which is retained between the top of tabs 38 and tabs 40. Tabs 50A of pressure bar 50 are inserted into slots 22A and 23A of flanges 22 and 23 respectively. Printer element 48 is mounted on the flanges as well.

Figure 4C:
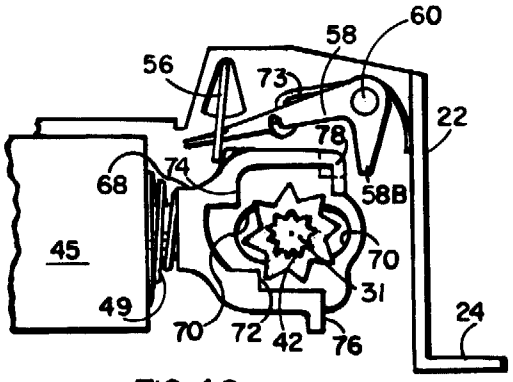
FIGS. 4*a*–4*c* are partially fragmented sectional views of the ratcheting mechanism of the apparatus shown in FIG. 1, illustrating the mode of operation of the apparatus of FIG. 1.
Figure 4B:
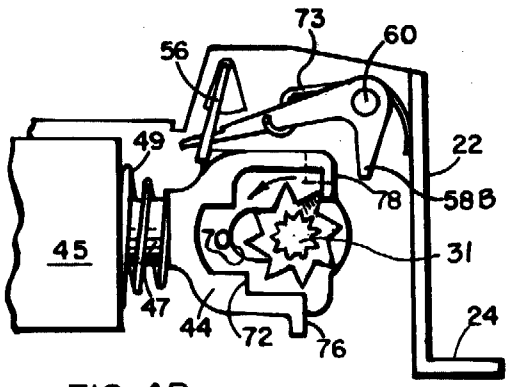
Figure 4A:
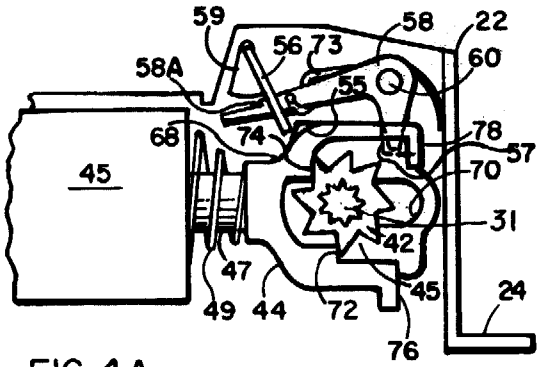

Referring now to FIGS. 4A–4C, there are shown side views of the invention that illustrate the ratcheting components that advance roller 32 in incremental steps and that activate the retracting mechanism. In FIG. 4A, Y-head driver 44 is shown in the neutral position. Y-head driver 44 may be formed of any suitable material, for example, molded plastic. Typically, head 44 includes a cavity 45 and an elongated slot 70 in the side thereof. Slot 70 is adjacent to side 18 of structure 12. Shaft 31 of roller 32 extends through slot 70 and is attached to ratchet wheel 42 by splines, for example. The relationship between shaft 31 and slot 70 permits driver 44 alignment to be maintained relative to ratchet 42. Slot 70 allows driver 44 to be moved forward and rearward, horizontally by plunger 47.

The inside cavity 45 of driver 44 includes ledges 72 and 74, flange 78 as well as abutment 55 and 57 at the top and flange 76 at the bottom. When the retracting mechanism is triggered by the energization of solenoid 45, plunger 47 retracts and initially pulls Y-head driver 44 to the left (as shown in FIG. 4A.) This initial movement moves abutment 57 away from arm 58B of latch 58 and also moves abutment 55 into contact with lever arm 56. Also, ledges 72 and 74 move away from the toothed surfaces of ratchet wheel 42.

As the solenoid continues to be activated, Y-head 44 continues to move to the left. Abutment 55 drives (rotates) lever arm 56 past the lip of latch 58. Latch 58 is then driven upwardly by torsion spring 73 to engage and retain lever arm 56 in the rotated position. Inasmuch as rotation of lever arm 56 moves retractor 52 and retracts pressure bar 50, pressure bar 50 is spaced away from print head 48.

At about this point in solenoid operation (although not limited thereto), flange 78 is drawn in contact with a ratchet tooth (shown shaded) that is positioned at approximately one o'clock (using an imaginary vertical line through the center of the ratchet as a 12 o'clock reference) as shown in FIG. 4B. Continued travel by head 44 rotates rachet wheel 42 approximately 8° (in one embodiment) counterclockwise as indicated by the arrow and brings another ratchet tooth to the 7 o'clock position in front of surface 72 of Y-head 44.

On the return stroke of the solenoid, spring 49 causes driver 44 to move toward the right in FIG. 4C. Ledge 72 engages and advances the appurtenant ratchet tooth from the 7 o'clock position to the 6 o'clock position, approximately. Substantially concurrently, the back of a ratchet tooth at 10 o'clock contacts the surface of ledge 74, i.e. the original starting position (see FIG. 4A) thereby effectively stopping rotation and aligning ratchet 42 in a preferred position. Since roller 32 is driven by ratchet 42, it advances the paper an incremental amount which is a function of roller 32 diameter, number of ratchet wheel teeth and the like. These conditions can be altered as desired in various embodiments.

In a preferred embodiment, roller 32 is rotated in increments of ⅙ revolution by ratchet member 42 affixed to the shaft 31 of roller 32. Of course, by appropriate design, the rotational increments may be changed if so desired.

In addition, as head 44 moves to the right, abutment 57 engages arm 58B of latch 58 and causes latch 58 to rotate. Rotation of latch 58 (against spring 73) releases lever 56. Release of lever arm 56 permits retractors 52 to move to the right whereby pressure bars 50 and 53 engage printer element 48. Thus, it is seen that operation of solenoid 45 first retracts pressure bar 50 (and stripper assembly 34) so that paper is free to move in the printer station. Then roller 32 is driven via ratchet wheel 42 to move the paper a prescribed distance. Then the pressure bar 50 (and pad 53) are returned to position to force the paper into contact with printer element 48.

Figure 5:
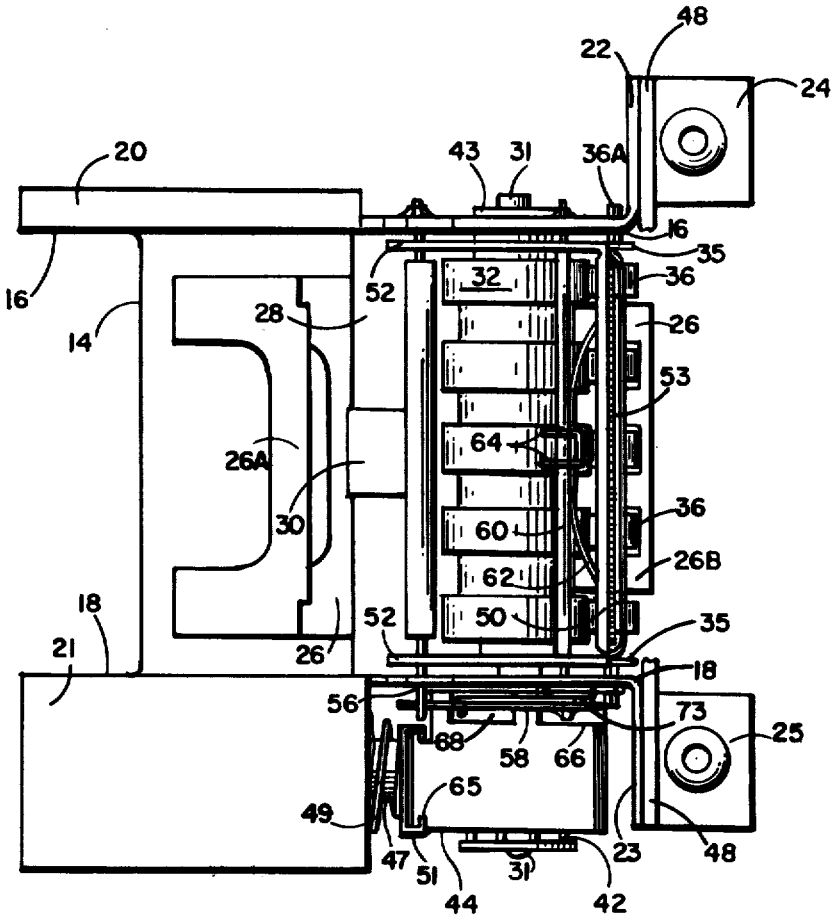
FIG. 5 is a partially cut away top view of the apparatus shown in FIG. 1.

Referring now to FIG. 5, there is shown a top view of the invention. In FIG. 5, pressure bar 50 is at least partially retracted. In this embodiment, roller 32 is formed of a suitable material of appropriate frictional coefficient for driving the paper. Roller 32 has a segmented configuration and is supported on shaft 31 which is mounted in frame 12 by inserting a shaft through apertures located in sides 16 and 18 thereof. Shaft 31 is retained at one end by a suitable fastener 43. The segments of roller 32 are spaced apart and generally align with collars 36 of the drive idler.

Ratchet 42 is joined to shaft 31 of roller 32. Y-head driver 44 is shown adjacent side 18 and fitting over ratchet 42. That is, ratchet 42 is disposed within cavity 45 of head 44 as shown in FIGS. 4A–4C. Driver 44 includes slits 65 and two contour surfaces 66 and 68 which effectively define surfaces 55 and ledge 78, respectively.

Clip 51 of the solenoid assembly engages Y-head driver 44 at slits 65 in order to join plunger 47 to head 44. Latch 58 of the retracting mechanism is shown adjacent Y-head 44 and in engagement with lever arm 56. between latch 58 and side 16 torsion spring 73 also arranged on shaft 60. Torsion spring 73 is formed such that one end engages latch 58 and the other end abuts the inside of flange 23.

The retracting mechanism is triggered when the initial motion of driver 44 to the left causes surface 55 to engage and to move lever arm 56 to the left in slot 59 (see FIG. 4A). Lever arm 56 causes lever bar 54 to rotate within slots 59 in sides 16 and 18 thereby causing retracting member 52 to move to the left thereby to retract pressure bar 50 from print station 48. Concurrently, paper stripper 34 is moved as well, whereby paper 11 is positively stripped from print element 48. Thus, the paper is not engaged at the print station during the advance cycle. During the return stroke of solenoid 45, driver 44 moves toward the right until surface 66 engages latch arm 58B (best shown in FIG. 4B) causing latch 58 to rotate about shaft 60 and against torsion spring 73. As latch 58 rotates, lever arm 56 is released from the latched position whereby lever pressure bar 54 and retractor 52 are released to move pressure bar 50 into engagement with print station 48. Thus, the apparatus is now ready for the printing cycle.

Figure 6:
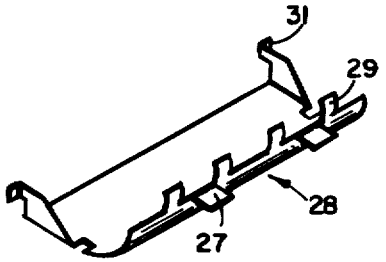
FIG. 6 is a perspective view illustrating details of the paper guide.

Referring to FIG. 6, there is shown a perspective view of paper guide 28 which has a concave configuration for accomodating roller 32. Paper guide 28 includes vertical tabs 29 disposed within the grooves of roller 32 to force the paper 11 into contact with roller 32. Horizontal tabs 27 fit underneath the collars of drive idler to provide support and exert upward pressure on the idler collars 36. Paper guide 28 is secured to the frame 12 by tabs 31 which are inserted into apertures in the frame.

FIG. 7 shows paper stripper 34 and drive idler 36. Tabs 37 forming the lower guide depend from large tabs 38 and the cutter edge 39 that form the upper guide for the paper. Those tabs 37 which depend from tabs 38 may be flared to more readily receive the paper. The collars of drive idler 36 fit between the lower guide tabs 37. Consequently, when paper 11 (not shown in FIG. 7) is advanced between roller 32 and the drive idler collars 36, the collars "pinch" the paper against roller 32 and also rotate while advancing the paper into the upper guide of paper stripper 34. Drive idler shaft 36A is fitted to paper stripper 34 at apertures in mounting tabs 35. Paper stripper 34, including drive idler 36, is mounted as one assembly on support structure 12 over paper guide 26. Once stripper 34 is mounted in structure 12, end tabs 40 are engaged to pressure bar 50 as noted supra.

Thus, it has been shown that a simplified paper advancing apparatus of the type described herein can unroll the paper from the supply roll, align the paper in the advance apparatus, advance the paper in precise increments, guide the paper so that once loaded in the apparatus the paper is self feeding, press the paper against the print station with a controlled pressure and alignment, retract the pressure pad from the paper and strip the paper from the print station in preparation for advancement.

As a result of this design, the parts of this apparatus may be manufactured and assembled in large quantities. Thus, an assembly is provided which is economically feasible without sacrificing the smooth advance function required in paper advance mechanisms. The embodiment shown and described is illustrative only. It is not meant to be limitative of the invention. Those skilled in the art may conceive modifications which can be made to the specific structures shown and described relative to the preferred embodiment. Any such changes or modifications which fall within the purview of the invention are intended to be included within this description. Rather, the scope of the invention is to be defined by the claims appended hereto.

Having thus described a preferred embodiment of the invention, what is claimed is:

1. An apparatus for advancing a web material in incremental steps comprising:
   a support structure;
   roller means supported by said support structure;
   web stripper means supported by said support structure and guide means forming a path for receiving said web material from said roller means and for exiting said web material;
   ratchet means attached to said roller means;
   driver means for selectively engaging and driving said ratchet in order to cause movement of said roller means to advance said web material when said driver means moves in a first direction;
   pressure means supported by said support structure for applying pressure to said web material; and
   retracting means for retracting said pressure means in response to operation of said driver means in a second direction.

2. The apparatus recited in claim 1 wherein said support structure includes a base member,
   a pair of parallel sides which extend upwardly from said base member, and horizontally beyond said base member, at least one of said parallel sides having a mounting flange in the rear portion thereof and at the front portion thereof.

3. The apparatus recited in claim 1 wherein said roller means includes a shaft having a splined end,
   said shaft attached to said ratchet means,
   said roller means having a plurality of segments arranged in spaced-apart relationship.

4. The apparatus recited in claim 3 wherein said ratchet means includes a plurality of teeth to be engaged by said driver means.

5. The apparatus recited in claim 1 including
   idler means supported by said support structure adjacent said roller means in order to maintain said web material in contact with said roller means, and
   further guide means supported by said support structure for directing said web material between said roller means and said idler means.

6. The apparatus recited in claim 5 wherein said guide means has a concave configuration for accommodating said roller means, and
   said guide means includes vertical and horizontal tabs,
   said vertical tabs arranged to wrap around said roller means to force said material into contact with said roller means, and
   said horizontal tabs exert upward pressue on said idler means.

7. The apparatus recited in claim 5 wherein said further guide means includes a vertical spring member arranged to lead said web material into said guide means in a direction assuring approximately 90° to 120° arc of contact between said web material and said roller means.

8. An apparatus as recited in claim 5 wherein said idler means includes a plurality of rotatably mounted collars, said collars have irregular surfaces adjacent portions of said roller means,
   tab portions of said web stripper means disposed between said collars to guide said web material away from said collars and through said web stripper means whereby said collars and said roller means cooperate to advance said web material through said web stripper.

9. The apparatus recited in claim 1 wherein said driver means includes at least two surfaces for engaging said retracting means, and
   at least two surfaces for engaging said ratchet means.

10. The apparatus recited in claim 9 wherein said driver means comprises a substantially hollow head which includes a slot on the side adjacent to said support structure for enclosing the shaft of said roller means whereby said driver means is slidably guided by the side of said support structure in a horizontal reciprocating motion about said shaft.

11. The apparatus recited in claim 1 wherein said retracting means includes:
   at least two retracting members;
   one end of each of said retracting members connected to said pressure means;
   a pressure lever bar having a lever arm, said pressure lever bar engaged with the other end of each of said retracting members in spaced relationship from said pressure bar; and
   latch means supported by said support structure and selectively engaging said lever arm,
   said latch means adapted to maintain said pressure means in a retracted position in response to movement of said driver means in said first direction and to release said pressure means to a normal position in response to operation of said driver means in said second direction.

12. An apparatus for advancing record material in precise increments for making contact with printing means comprising:
   a structure in which said record material can be advanced;
   storage means comprising an arrangement on said structure for keeping said record material in roll form for subsequent use, said arrangement comprising an idler spring extended over the base of said structure forming an inertia spring to allow for the supply roll inertia and for record material feed resistance.
   alignment means for stabilizing the record material in said structure;
   rotating means for advancing said record material comprising a segmented roller formed on a shaft and a drive idler adjacent said roller having idler collars, said rolleer and idler collars adapted to rotate and advance said record material;
   guide means on said structure for directing said record material comprising a path arranged in a vertical direction in which said record material advances in response to said rotating means;
   ratcheting means for rotating said rollers arranged in proximity to said segmented roller comprising a plastic ratchet member having a plurality of teeth including a collar for inserting said roller shaft;

driver means for rotating said ratchet means comprising a cavity structure having active surfaces which engage said ratchet teeth in precise sequence activating said rotating means and advancing said record material one increment;

solenoid means on said structure having plunger means for retracting and advancing said driver means in response to energizing and de-energizing of said solenoid means;

pressure bar means on said structure for assuring intimate contact of said record material with said printing means; and retracting means on said structure for disengaging said pressure bar means from said printing means and stripping said record material from said printing means during advance cycle of said record material, said retracting means comprised of an assembly mounted adjacent to said driver and responsive to the forward and rearward motion of said driver means.

13. An intermittent web advancing device having a ratchet mechanism including a support structure, a ratchet wheel rotatably mounted on said support structure, and a reciprocatable bifurcated plunger movable tangentially toward and away from said ratchet wheel, said plunger having the free end of a first furcation forming a pawl extending at right angls to its direction of motion for entering into an interdental space of the ratchet wheel for driving said ratchet wheel when said plunger moves away from said ratchet wheel, said plunger including a surface of the second furcation forming a pawl extending at right angles to its direction of motion for entering a different interdental space of the ratchet wheel for driving the said ratchet wheel when said plunger moves toward said ratchet wheel.

14. The device recited in claim 13 including latch means movably mounted on said support structure, said plunger having a first surface on said first furcation for engaging said latch means to release said latch means when said plunger moves toward said ratchet wheel;

said plunger having a second surface on said first furcation for engaging said latch means to latch said latch means when said plunger moves away from said ratchet wheel.

15. The device recited in claim 13 including solenoid means connected to said plunger for driving said plunger forward and rearward from said ratchet wheel in response to energizing and de-energizing of said solenoid means.

16. The device recited in claim 13 including pressure means for applying pressure to said web; and retracting means for disengaging said pressure means and stripping said web material during the advancing of said web material, said retracting means comprising an assembly mounted adjacent said plunger and responsive to the engaging and disengaging of said latch means.

* * * * *